US005388532A

United States Patent [19]

Wakano

[11] Patent Number: 5,388,532

[45] Date of Patent: Feb. 14, 1995

[54] PALLET FOR CONVEYING AND HOLDING GLASS PLATES

[75] Inventor: Kozo Wakano, Matsusaka, Japan

[73] Assignee: Central Glass Co., Ltd., Yamaguchi, Japan

[21] Appl. No.: 83,276

[22] Filed: Jun. 29, 1993

[30] Foreign Application Priority Data

Jun. 29, 1992 [JP] Japan ..... 4-045018[U]

[51] Int. Cl.[6] ..... B65D 19/44

[52] U.S. Cl. ..... 108/55.1; 108/54.1

[58] Field of Search ..... 108/55.1, 54.1, 51.1

[56] References Cited

U.S. PATENT DOCUMENTS

| | | | |
|---|---|---|---|
| 3,438,343 | 4/1969 | McConnell | 108/55.1 X |
| 3,499,398 | 3/1970 | Murray | 108/55.1 X |
| 3,850,295 | 11/1977 | Black | 108/55.1 X |
| 4,261,470 | 4/1981 | Dolan | 108/55.1 X |
| 4,445,616 | 5/1984 | Mancusi | 108/55.1 X |

FOREIGN PATENT DOCUMENTS

| | | | |
|---|---|---|---|
| 848319 | 10/1939 | France | 108/55.1 |
| 1378445 | 12/1974 | United Kingdom | 108/55.1 |
| 783133 | 12/1980 | U.S.S.R. | 108/54.1 |
| 1594075 | 9/1990 | U.S.S.R. | 108/54.1 |

*Primary Examiner*—Jose V. Chen

*Attorney, Agent, or Firm*—Cushman, Darby & Cushman

[57] ABSTRACT

A pallet for conveying and holding glass plates of various sizes includes a rectangular floor framework, a front stanchion inserted into a front stanchion support disposed at each front corner of the floor framework, a rear stanchion inserted into a rear stanchion support disposed at each rear corner of the floor framework, a rear framework supported by the rear stanchions, a headrest supported by the rear framework, longitudinally extending floor beams supported by the floor framework, a bar and pin assembly for stepwise adjusting the levels of the front stanchions, a bar and an assembly for stepwise adjusting the levels of the rear stanchions, a pin assembly for stepwise adjusting the level of the headrest, a sliding bar and pin assembly for stepwise adjusting the distances between the floor beams, an assembly for transversely bringing down and pulling up the front stanchion supports, and an assembly for longitudinally bringing down and pulling up the rear stanchions.

13 Claims, 5 Drawing Sheets

PALLET FOR CONVEYING AND HOLDING GLASS PLATES

BACKGROUND OF THE INVENTION

The present invention relates to a pallet for conveying and holding glass plates of various sizes.

Various kinds of pallets for conveying and holding glass plates have been proposed. For example, Japanese Patent Laid-Open Publication Sho 60-123379 discloses a pallet comprising a pair of front stanchions, a pair of rear stanchions , a rear framework supported by the rear stanchions, a pair of floor beams for supporting the lower edges of glass plates loaded thereon, the floor beams being disposed adjacent to each other in the transverse direction, a pair of headrests for supporting upper parts of the glass plates, the headrests being disposed adjacent to each other in the transverse direction, means for adjusting the transverse distance between the floor beams, means for adjusting the transverse distance between the headrests, and means for adjusting the vertical positions of the headrests.

The above adjusting means have screw shafts, which are expensive and require careful maintenance (lubrication). The lubricating oil or grease is likely to foul the glass plates. Therefore, maintenance of the pallet disclosed in Japanese Patent Laid-Open Publication Sho 60-123379 requires great care and is therefore troublesome.

The front stanchions and the rear framework of the pallet disclosed in Japanese Patent Laid-Open Publication Sho 60-123379 are not collapsible, so that it is hard to stack the pallets. Therefore, they cannot be stored in a small space.

SUMMARY OF THE INVENTION

An object of the present invention is to provide a pallet for conveying and holding glass plates of various sizes, which is inexpensive to manufacture and easy to maintain, and a plurality of which can be stored in a small space.

According to the present invention, there is provided a pallet for conveying and holding glass plates of various sizes comprising a rectangular floor framework, a front stanchion inserted into a front stanchion support disposed at each front corner of the floor framework, a rear stanchion inserted into a rear stanchion support disposed at each rear corner of the floor framework, a rear framework supported by the rear stanchions, a headrest supported by the rear framework, longitudinally extending floor beams supported by the floor framework, means for adjusting stepwise the levels of the front stanchions, means for adjusting stepwise the levels of the rear stanchions, means for adjusting stepwise the level of the headrest, means for adjusting stepwise the distances between the floor beams, means for transversely bringing down and pulling up the front stanchion supports, and means for longitudinally bringing down and pulling up the rear stanchions.

According to a preferred embodiment of the present invention, the means for adjusting stepwise the levels of the front stanchions has a plurality of horizontal grooves formed in the inner surfaces of the front stanchion supports at different levels and plates which can engage the grooves, the means for adjusting stepwise the levels of the rear stanchions has a plurality of horizontal grooves formed in the inner surfaces of the rear stanchion supports at different levels and plates which can engage the grooves, the means for adjusting stepwise the level of the headrest has a plurality of holes formed in the rear framework at different levels and a bar which engages one of the holes and the headrest, and the means for adjusting stepwise the distances between the floor beams has a plurality of holes formed in the floor framework at different transverse positions and pins which engage one of the holes and the floor beams.

According to another aspect of the present invention, there is provided a pallet for conveying and holding glass plates of various sizes comprising a rectangular floor framework, a front stanchion inserted into a front stanchion support disposed at each front corner of the floor framework, a rear stanchion inserted into a rear stanchion support disposed at each rear corner of the floor framework, a rear framework supported by the rear stanchions, a headrest supported by the rear framework, longitudinally extending floor beams supported by the floor framework, a pair of side stoppers supported by the floor framework, rear stoppers engaging the floor beams, means for adjusting stepwise the levels of the front stanchions, means for adjusting stepwise the levels of the rear stanchions, means for adjusting stepwise the level of the headrest, means for adjusting stepwise the distances between the floor beams, means for adjusting stepwise the distance between the side stoppers, means for adjusting stepwise the longitudinal positions of the rear stoppers, means for transversely bringing down and pulling up the front stanchion supports, and means for longitudinally bringing down and pulling up the rear stanchions.

According to a preferred embodiment of the present invention, the means for adjusting stepwise the levels of the front stanchions has a plurality of horizontal grooves formed in the inner surfaces of the front stanchion supports at different levels and plates which can engage the grooves, the means for adjusting stepwise the levels of the rear stanchions has a plurality of horizontal grooves formed in the inner surfaces of the rear stanchion supports at different levels and plates which can engage the grooves, the means for adjusting stepwise the level of the headrest has a plurality of holes formed in the rear framework at different levels and a bar which engages one of the holes and the headrest, the means for adjusting stepwise the distances between the floor beams has a plurality of holes formed in the floor framework at different transverse positions and pins which engage one of the holes and the floor beams, the means for adjusting stepwise the distance between the side stoppers has transversely extending sliding bars fixed to the side stoppers, the sliding bars being provided with holes at different transverse positions, transversely extending channel bars for receiving the sliding bars fixed on the floor framework, the channel bars being provided with holes at different transverse positions, and pins which engage the holes in the sliding bars and the holes in the channel bars, and the means for adjusting stepwise the longitudinal positions of the rear stoppers has a plurality of holes formed in the floor beams at different longitudinal positions and pins which engage one of the holes and the rear stoppers.

Further objects, features and advantages of the present invention will become apparent from the Detailed Description of the Preferred Embodiments when read in conjunction with the accompanying drawings.

DETAILED DESCRIPTION OF THE PREFERRED EMBODIMENTS

A pallet for conveying and holding glass plates in accordance with a preferred embodiment of the present invention will be described with reference to FIGS. 1 to 5. In the following description, the directions indicated by arrows I, II, III, IV, V and VI in FIGS. 1 to 5 are referred to as the forward direction, rearward direction, rightward direction, leftward direction, upward direction and downward direction, respectively. Moreover, in the following description, the direction parallel to the arrows I, II is referred to as the longitudinal direction, the direction parallel to the arrows III, IV is referred to as the transverse direction, and the direction parallel to the arrows V, VI is referred to as the vertical direction.

Figure 1:
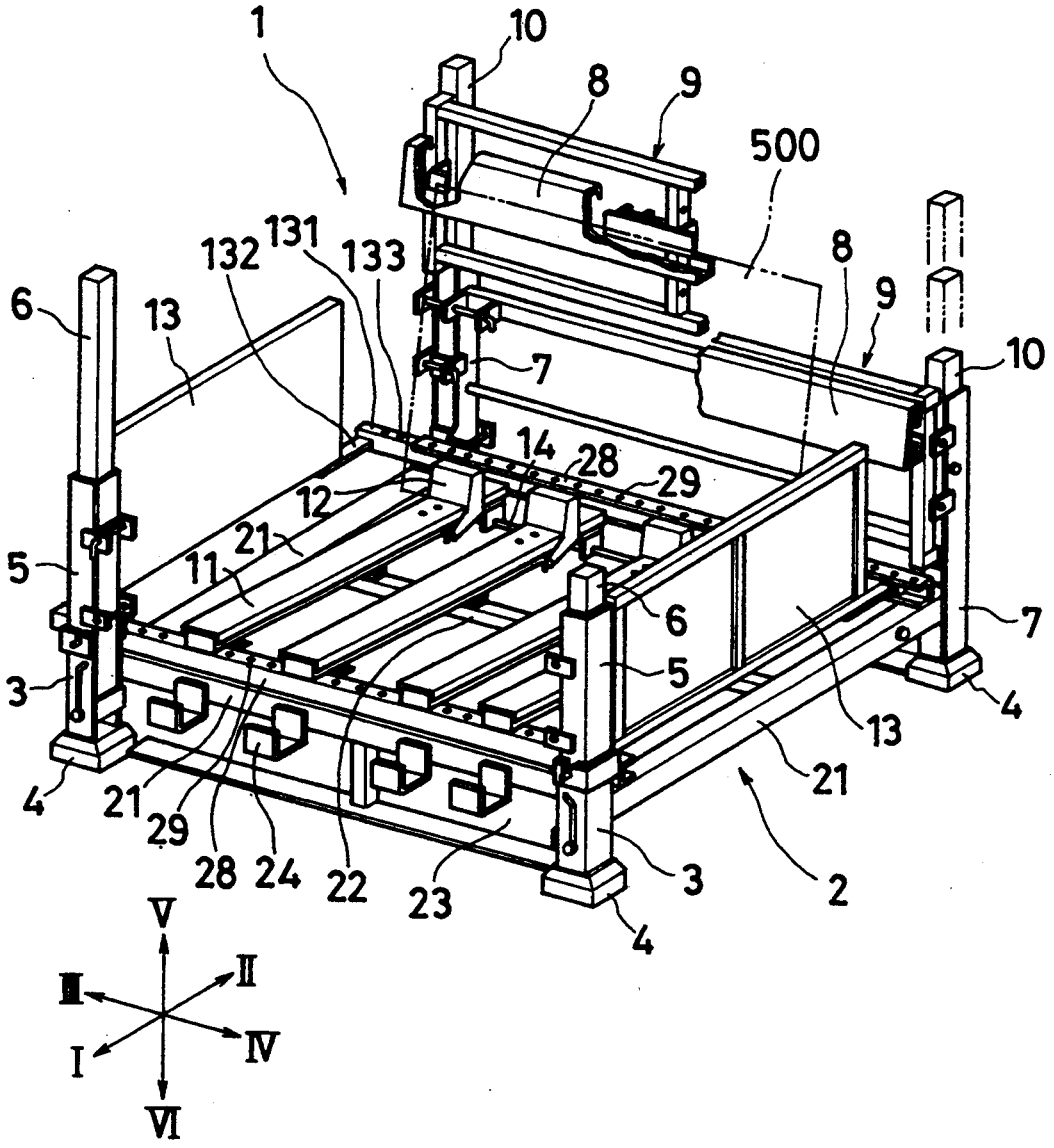
FIG. 1 is a perspective, partially cutaway view showing the general structure of a pallet for conveying and holding glass plates in accordance with a preferred embodiment of the present invention.

As shown in FIG. 1, a pallet 1 for conveying and holding glass plates has a floor framework 2 defined by rectangularly assembled outer beams 21 and a transverse inner beam 22 which connects one of the side outer beams 21 with the opposing one of the side outer beams 21. The floor framework 2 is disposed horizontally.

A vertically extending leg 3 provided with a base 4 at its lower end is fixed to each front corner of the floor framework 2. The leg 3 has a channel shaped horizontal cross section. The legs 3 are disposed so that the open sides thereof face one another. A front stanchion support 5 which has a channel shaped horizontal cross section is inserted into each leg 3. The front stanchion supports 5 are supported by the legs 3 to be movable in the vertical direction and rotatable around axes extending in the longitudinal direction. A front stanchion 6 is inserted into each front stanchion support 5. The front stanchions 6 are supported by the front stanchion supports 5 to be movable in the vertical direction.

A vertically extending rear stanchion support 7 which has a channel shaped horizontal cross section and is provided with a base 4 at its lower end is fixed to each rear corner of the floor framework 2. The open sides of the rear stanchion supports 7 are directed forward.

A transversely extending headrest 8 is mounted on the front side of a rear framework 9. The level of the headrest 8 can be adjusted relative to the rear framework 9. A vertically extending rear stanchion 10 is fixed to each transverse end of the rear framework 9. The rear stanchions 10 are inserted into the rear stanchion supports 7. The rear stanchions 10 are supported by the rear stanchion supports 7 to be rotatable around an axis extending in the transverse direction and movable in the vertical direction.

A plurality of floor beams 11 which extend in the longitudinal direction are engaged with the floor framework 2 to be movable in the transverse direction. A rear stopper 12 is engaged with each floor beam 11 to be movable in the longitudinal direction.

The floor framework 2 is provided with ports 23 for receiving the fork arm of a fork lift truck at its front and rear ends.

A pair of side stoppers 13 which extend in the longitudinal direction are engaged with the floor framework 2 to be movable in the transverse direction.

The structure of the legs 3 and the front stanchion supports 5 will be described, with particular attention being paid to the leg 3 and the front stanchion support 5 disposed at the right front corner of the floor framework 2.

Figure 2:
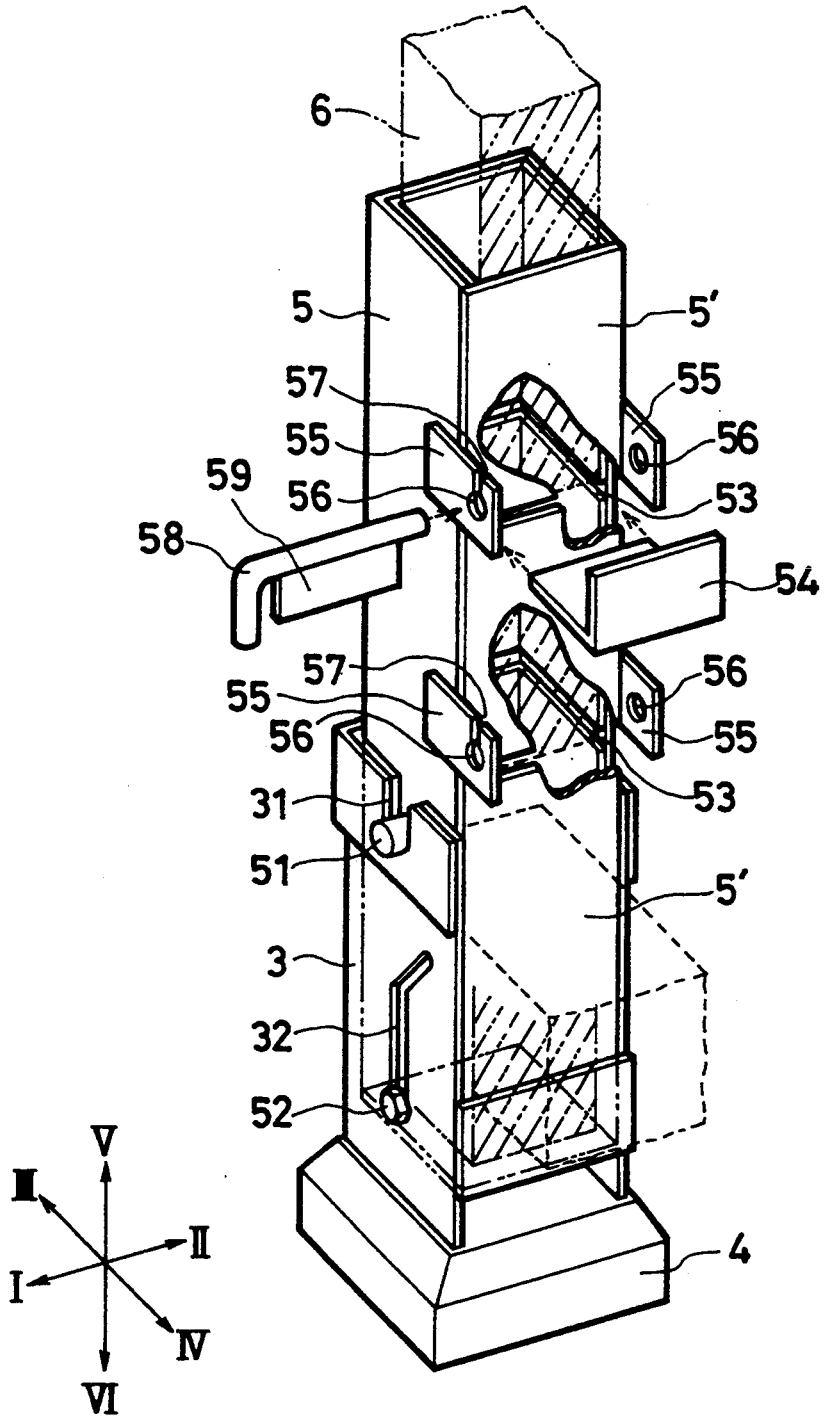
FIG. 2 is a perspective, partially cutaway view showing the structure of the front stanchion support of the pallet in FIG. 1.

As shown in FIG. 2, the open side of the leg 3 is directed leftward. A U-shaped cutout 31 is formed on each of the front and the rear upper edges of the leg 3. A vertically extending slit 32 is formed in the front wall of the leg 3. The upper portion of the slit 32 is slanted toward the open side of the leg 3 or leftward.

The open side of the front stanchion support 5 is directed leftward. The front stanchion support 5 is inserted into the leg 3. A pin 51 is fixed to each of the front and the rear walls of the front stanchion support 5. The pins 51 engage the U-shaped cutouts 31 so that the front stanchion support 5 is supported by the leg 3. A bolt 52 which engages the slit 32 is screwed into a tapped hole formed in the front wall of the front stanchion support 5. When the pins 51 engage the U-shaped cutout 31, the bolt 52 engages the lower end of the slit 32. If the front stanchion support 5 is lifted up, the pins 51 disengage from the U-shaped cutouts 31 and the bolt 52 moves upward along the slit 32. As the bolt 52 moves upward along the slanted upper portion of the slit 32, the clearance between the right wall of the front stanchion support 5 and the right wall of the leg 3 increases. Thus, when the bolt 52 reaches the upper end of the slit 32, the front stanchion support 5 can rotate around the longitudinal axis of the bolt 52, that is, the front stanchion support 5 can come down leftward until it abuts against angle plates 24 which are fixed to the front outer beam 21 of the floor framework 2.

A plurality of horizontal grooves 53 are formed in the inner side surface of the front stanchion support 5 at different levels. A plate 54 with an L-shaped cross section can be inserted into any one of the grooves 53. The front stanchion 6, which is inserted into the front stanchion support 5 is supported by the plate 54. Thus, the level of the front stanchion 6 can be adjusted stepwise by selecting the one of the grooves 53 into which the plate 54 is inserted. If the plate 52 is removed, the front stanchion 6 is supported by the bottom plate of the front stanchion support 5. This is the lowest level of the front stanchion 6.

A plate 55 is fixed to each of the front and the rear walls of the front stanchion support 5 at the level of each groove 53. A hole 56 is formed in each plate 55. The holes 56 formed in the plates 55 which are fixed to the front wall of the front stanchion support 5 are provided with slits 57 which extend between the upper edge of the plate 55 and the upper periphery of the hole 56. An L-shaped bar 58 provided with a plate 59 is inserted into the holes 56 of the plates 55 adjacent to the groove 53 into which the plate 54 has been inserted when the plate 59 is aligned with the slit 57. After the completion of the insertion of the L-shaped bar 58 into the holes 56, the L-shaped bar 58 is rotated by 180 degrees around its longitudinal axis so as to direct the plate 59 downward, whereby the L-shaped bar 58 can no longer be released from engagement with the holes 56. Thus the engagement between the plate 52 and the groove 53 is maintained by the L-shaped bar 58, while the engagement between the L-shaped bar 58 and the holes 56 is maintained by the plate 59.

The open side of the front stanchion support 5 is closed by plates 5' except at the parts adjacent to the horizontal grooves 53 so that the front stanchion 6 cannot come down leftward.

The structure of the leg 3 and the front stanchion support 5 disposed at the left front corner of the floor framework 2 is symmetrical to that of those disposed at the right front corner of the floor framework 2.

Figure 3:
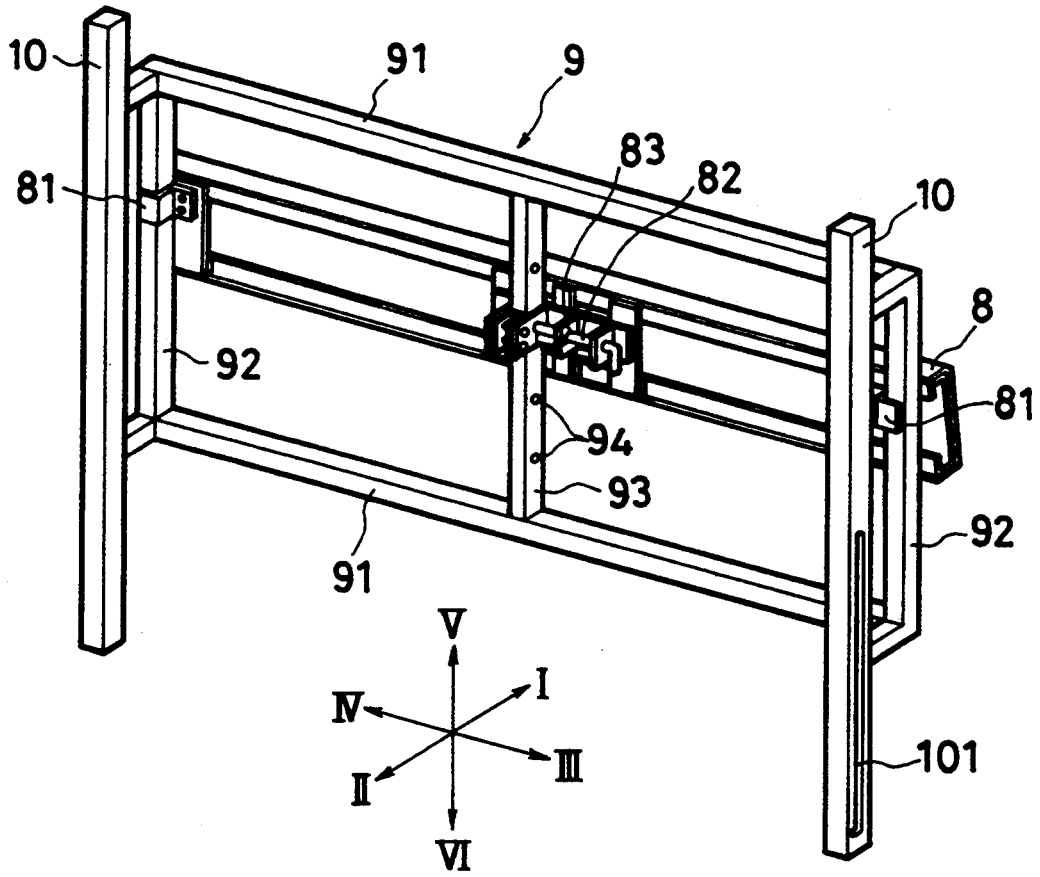
FIG. 3 is a rear view showing the structure of the rear framework of the pallet in FIG. 1.

The structure of the rear framework 9 will now be described with reference to FIG. 3.

The rear framework 9 is defined by upper and lower transverse beams 91, a pair of bracket-shaped vertical beams 92 which connect the opposite ends of the upper transverse beam 91 with the opposite ends of the lower transverse beam 91, and a vertical beam 93 which connects the midpoint of the upper transverse beam 91 with the midpoint of the lower transverse beam 91. The rear framework 9 is disposed so that the beams 91 protrude forward.

The transversely extending headrest 8 is provided with a L-shaped arm 81 at either end. The L-shaped arms 81 engage the bracket-shaped vertical beams 92 to be slidable in the vertical direction. A plurality of holes 94 are formed in the vertical beam 93 at predetermined vertical spacing. An L-shaped bar 82 extends in the transverse direction through holes formed in plates 83 fixed to the headrest 8 and one of the holes 92 so as to fix the headrest 8 to the rear framework 9. The engagement between the holes and the L-shaped bar 82 is maintained in the same way as that between the holes 56 and the L-shaped bar 58 of the front stanchion support 5. The level of the headrest 8 can be adjusted stepwise by selecting the one of the holes 94 with which the L-shaped bar 82 is engaged.

The rear stanchions 10 are fixed to the bracket-shaped vertical beams 92. A vertical groove 101 is formed in the outer side surface of each rear stanchion 10. The lower end of the vertical groove 101 is bent rearward.

The structure of the rear stanchion supports 7 will now be described, with particular attention paid to the rear stanchion support 7 disposed at the right rear corner of the floor framework 2.

Figure 4:
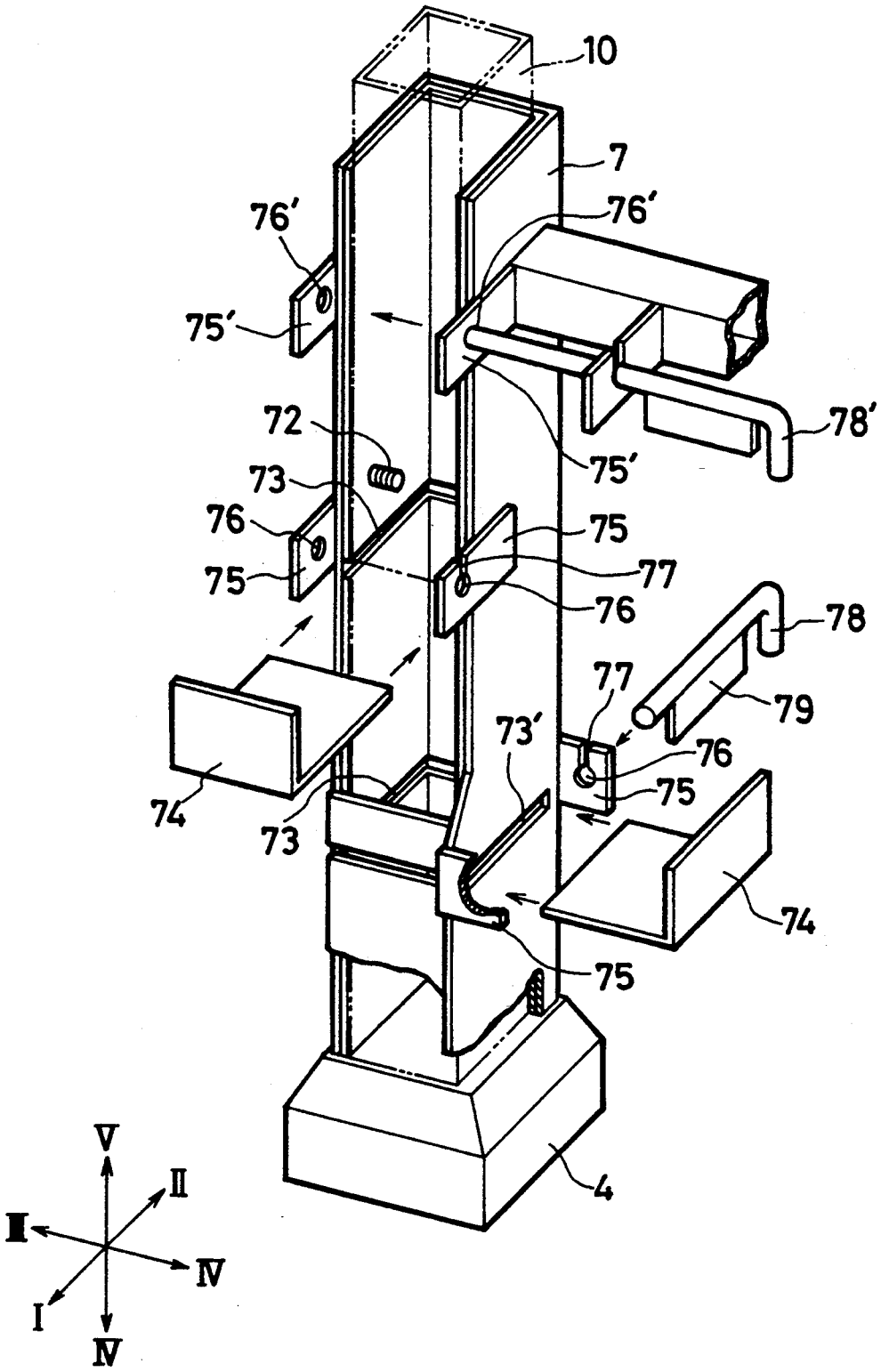
FIG. 4 is a perspective, partially cutaway view showing the structure of the rear stanchion support of the pallet in FIG. 1.

As shown in FIG. 4, the open side of the rear stanchion support 7 is directed forward. Similarly to the case of the front stanchion support 5, the rear stanchion support 7 is provided with horizontal grooves 73 in the inner side surface thereof, a plate 74 with an L-shaped cross section, plates 75 with holes 76 and slits 77, and an L-shaped bar 78 with a plate 79 so as to enable the level of the rear stanchion 10 inserted into the rear stanchion support 7 to be adjusted in steps. The lower portion of the open side of the rear stanchion support 7 is closed because this portion abuts against the right rear corner of the floor framework 2. A slit 73' is therefore formed in the lower part of the left wall of the rear stanchion support 7 for enabling the plate 74 to be inserted into the lowest groove 73. If the plate 74 is removed, the rear stanchion 10 is supported by the base 4, in which case the level of the rear stanchion 10 becomes lowest.

The rear stanchion 10 is prevented from coming down forward by an L-shaped bar 78' which engages holes 76' formed on plates 75' which are disposed above the uppermost groove 73. The engagement between the holes 76' and the L-shaped bar 78' is maintained in the same way as that between the holes 56 and the L-shaped bar 58 of the front stanchion support 5.

A transversely extending pin 72 is fixed to the inner surface of the right wall of the rear stanchion support 7 above the uppermost groove 73. The pin 72 engages the groove 101 formed in the rear stanchion 10. If the rear stanchion 10 is lifted up and then moved forward, the pin 72 moves along the groove 101 toward the lower end of the groove 101 and then moves rearward along the lower end portion of the groove 101 which is bent rearward. As the pin 72 moves rearward along the lower end portion of the groove 101, the clearance between the rear wall of the rear stanchion support 7 and the rear wall of the rear stanchion 10 increases. Thus, merely by disengaging the L-shaped bar 78' from the holes 76', it is possible to enable the rear stanchion 10 to rotate around the longitudinal axis of the pin 72, whereby the rear stanchion 10 can come down forward until the headrest 8 abuts against the floor beams 11.

The structure of the rear stanchion support 7 disposed at the left rear corner of the floor framework 2 is symmetrical to that of the rear stanchion support 7 disposed at the right rear corner of the floor framework 2.

The structure of the floor beams 11 and the rear stoppers 12 will now be described in detail, with particular attention being paid to the rightmost floor beam 11 and the rightmost rear stopper 12.

Figure 5:
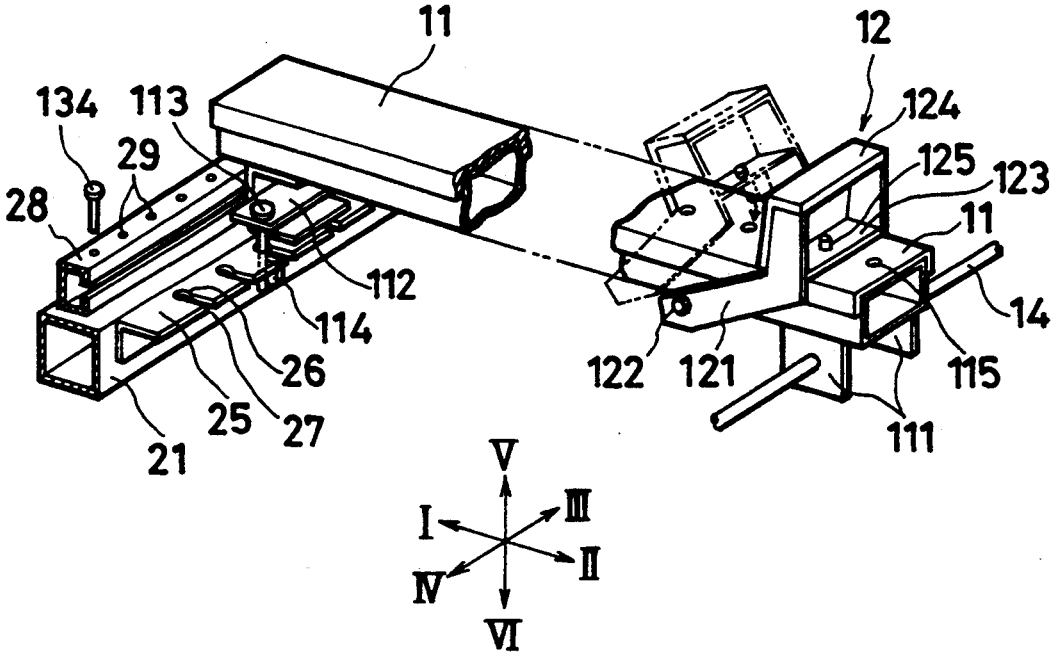
FIG. 5 is a perspective, partially cutaway view showing the structure of the floor beam and the rear stopper of the pallet in FIG. 1.

As shown in FIG. 1, a transversely extending guide bar 14 is detachably connected to the rear portion of the floor framework 2. As shown in FIG. 5, the guide bar 14 extends through a pair of brackets 111 which are fixed to the under surface of the rear end of the floor beam 11. Thus, the floor beam 11 is supported by the guide bar 14 to be slidable in the transverse direction. A plate 112 is fixed to a channel bar which is fixed to the under surface of the front end of the floor beam 11. A pin 113 with a head extends in the vertical direction through a hole formed in the plate 112 to be rotatable around its longitudinal axis. The pin 113 is provided with a plate 114 at its lower part. A transversely extending L-shaped plate 25 is fixed to the rear surface of the front outer beam 21 of the floor framework 2. A plurality of holes 26 are formed in the L-shaped plate 25 at predetermined transverse spacing. Each of the holes 26 is provided with a slit 27 which extends between the rear edge of the L-shaped plate 25 and the rear periphery of the hole 26. The pin 113 is inserted into one of the holes 26, with the plate 114 aligned with the slit 27. Then the pin 113 is rotated around its longitudinal axis so that the pin 113 can no longer be released from engagement with the hole 26. Thus, the floor beam 11 is fixed to the L-shaped plate 25. The transverse position of the floor beam 11 can be adjusted stepwise by selecting the one of the holes 26 with which the pin 113 is engaged.

A plurality of holes 115 are formed in the upper surface of the rear part of the floor beam 11 at predetermined longitudinal spacing. The rear stopper 12 has a pair of L-shaped arms 121 which are connected with each other by a transversely extending bar 122 at their lower ends, a transversely extending plate 123 at their midsections, and an L-shaped plate 124 at their front upper parts. The floor beam 11 extends through the space defined by the arms 121, the bar 122 and the plate 123. A pin 125 vertically extends through the plate 123 and is fixed to it. The pin 125 engages one of the holes 115 so that the rear stopper 12 is fixed to the floor beam 11. If the rear stopper 12 is rotated around the longitudinal axis of the bar 122 counterclockwise as viewed from the left, the pin 125 disengages from the hole 115. Then, the rear stopper 12 can be moved in the longitudinal direction. Thus, the longitudinal position of the rear stopper 12 can be adjusted stepwise by selecting the one of the holes 115 with which the pin 125 is engaged.

The structure of the side stoppers 13 will now be described in detail, with particular attention being paid to the right side stopper 13.

As shown in FIG. 1, each side stopper 13 is defined by an upright framework covered by a plate. The side stopper 13 extends in the longitudinal direction. A transversely extending sliding bar 131 is fixed to each of the front and the rear lower ends of the side stopper 13 through a flat bar 132. A plurality of holes 133 are formed in the upper surface of the sliding bar 131 at predetermined transverse spacing. As shown in FIGS. 1 and 5, a transversely extending channel bar 28 with a C-shaped cross section is fixed on each of the front and the rear outer beams 21. The channel bars 28 are disposed with their open sides opposed. A plurality of holes 29 are formed in the upper surface of each channel bar 28 at predetermined transverse spacing. The distance between the holes 29 is the same as that between the holes 133. The front and the rear sliding bars 133 are inserted into the front and the rear channel bars 28, respectively, to be movable in the transverse direction, with the flat bars 132 passing through the slits of the channel bars 28. A pin 134 (see FIG. 5) penetrates one of the holes 29 in the front channel bar 28 and the corresponding hole 133 in the front sliding bar 131. Another pin 131 penetrates one of the holes 29 in the rear channel bar 28 and the corresponding hole 133 in the rear sliding bar 131. Thus, the side stopper 13 is fixed to the front and the rear channel bars 28. The transverse position of the side stopper 13 can be adjusted stepwise by moving the sliding bars 131 in the transverse direction and inserting pins 134 into the holes 29 and the corresponding holes 133.

The front surface of the headrest 8, the upper surfaces of the floor beams 11, the front upper surfaces of the rear stoppers 12, and the opposing side surfaces of the side stoppers 13 are covered by rubber panels. Thus, the edges of the glass plates 500 (see FIG. 1) which are placed on the pallet 1 are safe from damage.

The operation of the pallet 1 will now be described.

The L-shaped plate 54 of each front stanchion support 5 is removed so as to bring each front stanchion 6 to the lowest level. The front stanchion supports 5 are brought down until they abut against the angle plates 24. In this condition, the top ends of the front stanchions 6 abut against each other. The side stoppers 13 are moved so as to increase the transverse distance between them.

The L-shaped plate 74 of each rear stanchion support 7 is inserted into a selected one of the grooves 73. The L-shaped bar 78 is inserted into the holes 76 of the plates 75 adjacent to the groove 73, with the plate 79 aligned with the slit 77. After the completion of the insertion of the L-shaped bar 78 into the holes 76, the L-shaped bar 78 is rotated by 180 degrees around its longitudinal axis. Thus the engagement between the L-shaped plate 74 and the groove 73, and that between the L-shaped bar 78 and the holes 76 is maintained. The rear stanchions 10 inserted into the rear stanchion supports 7 are supported by the L-shaped plates 74. The L-shaped bar 82 is inserted into a selected one of the holes 94. Thus, the level of the rear framework 9 and the level of the headrest 8 are adjusted to be optimum for accommodating the glass plates 500 to be held.

The floor beams 11 are moved in the transverse direction. The pins 113 are inserted into the holes 26, with the plates 114 aligned with the slits 27. Then the pins 113 are rotated around their longitudinal axes so as to fix the floor beams 11 to the L-shaped plate 25. Thus, the distances between the floor beams 11 are adjusted to be optimum for accommodating the glass plates 500.

The rear stoppers 12 are moved in the longitudinal direction. The pins 125 are engaged with the holes 115 so as to fix the rear stoppers 12 to the floor beams 11. Thus, the longitudinal positions of the rear stoppers 12 are adjusted to optimize the inclination of the glass plates 500.

The glass plates 500 are placed one over another against the headrest 8 with their bottom edges resting on the floor beams 11, and with their inclination being restricted by the rear stoppers 12.

The side stoppers 13 are moved in the transverse direction until they abut against the side edges of the glass plates 500. Then the pins 134 are engaged with the holes 29 and the holes 133 so as to fix the side stoppers 13 to the channel bars 28.

The glass plates 500 placed one over another against the headrest 8 are bound to the pallet 1 with ropes. The ropes are omitted from the drawings in the interest of simplicity.

The front stanchion supports 5 are pulled up. The bolts 52 engage the lower ends of the slits 32, and the pins 51 engage the U-shaped cutouts 31. Thus, the front stanchion supports 5 are held upright. The front stanchions 6 are lifted up. The L-shaped plate 52 of the each front stanchion support 5 is inserted into a selected one of the grooves 53. The L-shaped bar 58 is inserted into the holes 56 of the plates 55 adjacent to the groove 53, with the plate 59 aligned with the slit 57. After the completion of the insertion of the L-shaped bar 58 into the holes 56, the L-shaped bar 58 is rotated by 180 degrees around its longitudinal axis. Thus the engagement between the L-shaped plate 54 and the groove 53, and that between the L-shaped bar 58 and the holes 56 is maintained. The front stanchions 6 are supported by the L-shaped plates 54. Thus, the levels of the front stanchions 6 are adjusted to be optimum for accommodating the glass plates 500. The front stanchions 6 operate as fenders to protect the glass plates 500 and as supports for covering sheets.

The pallet 1 holding the glass plates 500 is transferred to an unloading site by a forklift truck. Then, the pallet 1 is placed on the ground.

The plates 54 of the front stanchion supports 5 are removed to allow the front stanchions 6 to pass into the front stanchion supports 5. The front stanchion supports 5 are lifted up so that the pins 51 disengage from the U-shaped cutouts 31 and the bolts 52 engage the upper ends of the slits 32. Then the front stanchion supports 5 are brought down in the transverse direction until they abut against the angle plates 22. Thus, the obstructions in front of the glass plates 500 are removed.

The pins 134 are disengaged from the holes 29 and the holes 133. The side stoppers 13 are moved in the transverse direction so as to increase the distance between them. Thus, the obstructions at opposite sides of the glass plates 500 are removed.

The glass plates 500 are unloaded from the pallet 1.

The L-shaped plates 74 of the rear stanchion supports 7 are removed. The L-shaped bars 78' are disengaged from the holes 76'. The rear stanchions 10 are lifted up and moved forward so that the pins 72 engage the lower ends of the grooves 101. Then the rear stanchions 10 are brought down forward until the headrest 8 abuts against the floor beams 11. Thus, the empty pallet 1 is made compact and flat. The empty pallets 1 which are made compact and flat are stacked for storage. Thus, they can be stored in a small space.

As described above, in the pallet in accordance with the above embodiment of the present invention, the level of the front stanchions 6, the level of the rear stanchions 10, the level of the headrest 8, the transverse position of the floor beams 11, the longitudinal position of the rear stoppers 12, and the transverse position of the side stoppers 13 are adjusted by means of the engagements between L-shaped plates and grooves, and engagements between pins and holes. The structures of the above described adjusting means are by far simpler than those of the conventional screw shafts. The above described adjusting means do not require careful maintenance (lubrication).

The front stanchion supports 5 and the rear stanchions 10 are collapsible so that the pallets in accordance with the above embodiment can be stacked for storage.

Thus, in accordance with the present invention, there is provided a pallet for conveying and holding glass plates of various sizes, which is inexpensive to manufacture and easy to maintain, and a plurality of which can be stored in a small space.

While the present invention has been described with reference to the preferred embodiments, one of ordinary skill in the art will recognize that modifications and improvements may be made while remaining within the spirit and scope of the present invention. The scope of the invention is determined solely by the appended claims.

I claim:

1. A pallet for conveying and holding glass plates of various sizes comprising:

a rectangular floor framework having two front corners and two rear corners;

a front stanchion support disposed at each front corner of the floor framework;

a front stanchion inserted into each front stanchion support;

a rear stanchion support disposed at each rear corner of the floor framework;

a rear stanchion inserted into each rear stanchion support;

a rear framework connected to the rear stanchions and movable therewith;

a headrest connected to the rear framework at a particular level relative to the rear framework;

a plurality of longitudinally extending floor beams supported by the floor framework;

means for stepwise adjusting respective levels of the front stanchions;

means for stepwise adjusting respective levels of the rear stanchions and thereby also the level of the rear framework and headrest;

means for stepwise adjusting the level of the headrest relative to the rear framework;

means for stepwise adjusting distances between the floor beams;

means for rotating the front stanchion supports down toward the floor framework; and means for rotating the rear stanchions down toward the floor framework.

2. A pallet for conveying and holding glass plates of various sizes comprising:

a rectangular floor framework having two front corners and two rear corners;

a front stanchion support disposed at each front corner of the floor framework;

a front stanchion inserted into each front stanchion support;

a rear stanchion support disposed at each rear corner of the floor framework;

a rear stanchion inserted into each rear stanchion support;

a rear framework connected to the rear stanchions and movable therewith;

a headrest connected to the rear framework at a particular level relative to the rear framework;

a plurality of longitudinally extending floor beams supported by the floor framework;

a pair of side stoppers supported by the floor framework;

rear stoppers engaging the floor beams;

means for stepwise adjusting respective levels of the front stanchions;

means for stepwise adjusting respective levels of the rear stanchions and thereby also the level of the rear framework and headrest;

means for stepwise adjusting the level of the headrest relative to the rear framework;

means for stepwise adjusting distances between the floor beams;

means for stepwise adjusting a distance between the side stoppers;

means for stepwise adjusting respective longitudinal positions of the rear stoppers;

means for rotating the front stanchion supports down toward the floor framework; and means for rotating the rear stanchions down toward the floor framework.

3. A pallet of claim 1, wherein the means for stepwise adjusting the respective levels of the front stanchions comprises a plurality of horizontal grooves formed in inner surfaces of the front stanchion supports at different levels and plates for engaging the grooves.

4. A pallet of claim 3, wherein the means for stepwise adjusting the levels of the rear stanchions comprises a plurality of horizontal grooves formed in inner surfaces of the rear stanchion supports at different levels, and plates for engaging the grooves.

5. A pallet of claim 4, wherein the means for stepwise adjusting the level of the headrest comprises a plurality of holes formed in the rear framework at different levels and a bar which engages one of the holes and the headrest.

6. A pallet of claim 5, wherein the means for stepwise adjusting distances between the floor beams comprises a plurality of holes formed in the floor framework at different transverse positions and pins for engaging one of the holes and one of the floor beams.

7. A pallet of claim 2, wherein the means for stepwise adjusting the respective levels of the front stanchions comprises a plurality of horizontal grooves formed in inner surfaces of the front stanchion supports at different levels and plates for engaging the grooves.

8. A pallet of claim 7, wherein the means for stepwise adjusting the respective levels of the rear stanchions comprising a plurality of horizontal grooves formed in inner surfaces of the rear stanchion supports at different levels and plates for engaging the grooves.

9. A pallet of claim 8, wherein the means for stepwise adjusting the level of the headrest comprises a plurality of holes formed in the rear framework at different levels and a bar for engaging one of the holes and the headrest.

10. A pallet of claim 9, wherein the means for stepwise adjusting distances between the floor beams comprises a plurality of holes formed in the floor framework at different transverse positions and pins for engaging one of the holes and one of the floor beams.

11. A pallet of claim 10, wherein the means for stepwise adjusting a distance between the side stoppers comprises a transversely extending sliding bar fixed to each side stopper, wherein the sliding bars are provided with holes at different transverse positions;

a transversely extending channel bar for slidingly receiving the sliding bars, wherein the channel bar is fixed on the floor framework, and wherein the channel bar is provided with holes at different transverse positions; and a plurality of pins for engaging a hole in a sliding bar and a hole in a channel bar to fix the relative position of the sliding bar and the channel bar.

12. A pallet of claim 11, wherein the means for stepwise adjusting longitudinal positions of the rear stoppers comprises a plurality of holes formed in the floor beams at different longitudinal positions, and pins engaging one of the holes and fixing the relative positions of the floor beams and the rear stoppers.

13. A pallet of claim 11, comprising a first channel bar fixed to the front of the floor framework, and a second channel bar fixed to the rear of the floor framework, wherein each side stopper comprises a front and rear sliding bar for sliding in the first and second channel bars, respectively.

* * * * *